US006595394B1

(12) United States Patent
Savala

(10) Patent No.: US 6,595,394 B1
(45) **Date of Patent: *Jul. 22, 2003**

(54) SPILL REDUCING DEVICE FOR A PITCHER

(76) Inventor: Jimmy L. Savala, 446 N Lake Ave., Calipatria, CA (US) 92233

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/071,450

(22) Filed: Feb. 8, 2002

(51) Int. Cl.[7] ..... B67D 5/58
(52) U.S. Cl. ..... 222/189.07; 220/719
(58) Field of Search ..... 222/189.02; 220/719; 210/469

(56) References Cited

U.S. PATENT DOCUMENTS 3,360,160 A * 12/1967 Spencer ..... 220/719
D252,846 S 9/1979 Miller
4,938,375 A * 7/1990 Fantacone ..... 222/189.07
5,246,149 A 9/1993 Broitzman
5,275,307 A 1/1994 Freese
5,289,953 A 3/1994 McMillan et al.
5,370,258 A * 12/1994 Fair ..... 222/719
5,388,729 A * 2/1995 Gerringer ..... 222/189.07
5,443,184 A 8/1995 Broitzman
5,803,316 A 9/1998 Couture
5,857,584 A * 1/1999 Taggart ..... 220/719
6,126,018 A * 10/2000 Cone et al. ..... 210/469

* cited by examiner

*Primary Examiner*—Philippe Derakshani

(57) ABSTRACT

A spill reducing device for a pitcher for preventing solid material from pouring out of a pitcher with liquid in the pitcher. The spill reducing device for a pitcher includes a dampening member for slowing outward flow of liquid from a pitcher. The dampening member is removably positionable in the pitcher between a pour spout and a remaining inner portion of the pitcher. The dampening member includes an annular member having an inner peripheral edge and an outer peripheral edge. The outer peripheral edge has a diameter generally equal to a diameter of the peripheral wall such that the outer peripheral edge may frictionally engage the inner surface of the peripheral wall. A wall is attached to the outer peripheral edge and extends downwardly from the annular member. The wall has a plurality of apertures extending therethrough.

12 Claims, 4 Drawing Sheets

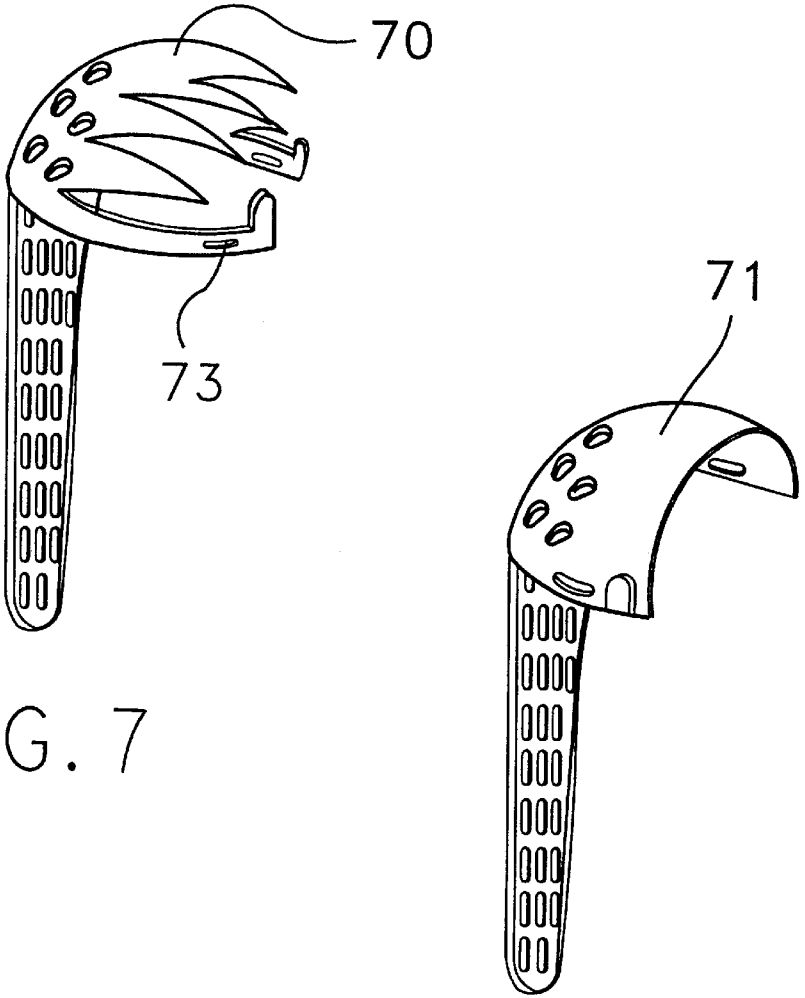
FIG. 8
FIG. 7
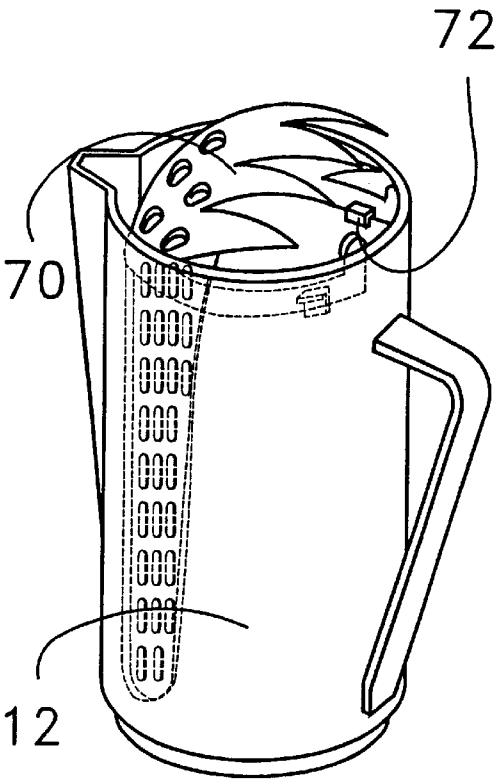
FIG. 6

SPILL REDUCING DEVICE FOR A PITCHER

BACKGROUND OF THE INVENTION

1. Field of the Invention

The present invention relates to pitchers and spill reducing devices and more particularly pertains to a new spill reducing device for a pitcher for preventing solid material from pouring out of a pitcher with liquid in the pitcher.

2. Description of the Prior Art

The use of pitchers and spill reducing devices is known in the prior art. More specifically, pitchers and spill reducing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,803,316; U.S. Pat. No. 5,443,184; U.S. Pat. No. 5,289,953; U.S. Pat. No. 5,246,149; U.S. Des. Pat. No. 252,846; and U.S. Pat. No. 5,275,307.

While these devices fulfill their respective, particular objectives and requirements, the aforementioned patents do not disclose a new spill reducing device for a pitcher. The inventive device includes a dampening member for slowing outward flow of liquid from a pitcher. The dampening member is removably positionable in the pitcher between a pour spout and a remaining inner portion of the pitcher. The dampening member includes an annular member having an inner peripheral edge and an outer peripheral edge. The outer peripheral edge has a diameter generally equal to a diameter of the peripheral wall such that the outer peripheral edge may frictionally engage the inner surface of the peripheral wall. A wall is attached to the outer peripheral edge and extends downwardly from the annular member. The wall has a plurality of apertures extending therethrough.

In these respects, the spill reducing device for a pitcher according to the present invention substantially departs from the conventional concepts and designs of the prior art, and in so doing provides an apparatus primarily developed for the purpose of preventing solid material from pouring out of a pitcher with liquid in the pitcher.

SUMMARY OF THE INVENTION

In view of the foregoing disadvantages inherent in the known types of pitchers and spill reducing devices now present in the prior art, the present invention provides a new spill reducing device for a pitcher construction wherein the same can be utilized for preventing solid material from pouring out of a pitcher with liquid in the pitcher.

The general purpose of the present invention, which will be described subsequently in greater detail, is to provide a new spill reducing device for a pitcher apparatus and method which has many of the advantages of the pitchers and spill reducing devices mentioned heretofore and many novel features that result in a new spill reducing device for a pitcher which is not anticipated, rendered obvious, suggested, or even implied by any of the prior art pitchers and spill reducing devices, either alone or in any combination thereof.

To attain this, the present invention generally comprises a dampening member for slowing outward flow of liquid from a pitcher. The dampening member is removably positionable in the pitcher between a pour spout and a remaining inner portion of the pitcher. The dampening member includes an annular member having an inner peripheral edge and an outer peripheral edge. The outer peripheral edge has a diameter generally equal to a diameter of the peripheral wall such that the outer peripheral edge may frictionally engage the inner surface of the peripheral wall. A wall is attached to the outer peripheral edge and extends downwardly from the annular member. The wall has a plurality of apertures extending therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spill reducing device for a pitcher apparatus and method which has many of the advantages of the pitchers and spill reducing devices mentioned heretofore and many novel features that result in a new spill reducing device for a pitcher which is not anticipated, rendered obvious, suggested, or even implied by any of the prior art pitchers and spill reducing devices, either alone or in any combination thereof.

It is another object of the present invention to provide a new spill reducing device for a pitcher which may be easily and efficiently manufactured and marketed.

It is a further object of the present invention to provide a new spill reducing device for a pitcher which is of a durable and reliable construction.

An even further object of the present invention is to provide a new spill reducing device for a pitcher which is susceptible of a low cost of manufacture with regard to both materials and labor, and which accordingly is then susceptible of low prices of sale to the consuming public, thereby making such spill reducing device for a pitcher economically available to the buying public.

Still yet another object of the present invention is to provide a new spill reducing device for a pitcher which provides in the apparatuses and methods of the prior art some of the advantages thereof, while simultaneously overcoming some of the disadvantages normally associated therewith.

Still another object of the present invention is to provide a new spill reducing device for a pitcher for preventing solid material from pouring out of a pitcher with liquid in the pitcher.

Yet another object of the present invention is to provide a new spill reducing device for a pitcher which includes a dampening member for slowing outward flow of liquid from a pitcher. The dampening member is removably positionable in the pitcher between a pour spout and a remaining inner portion of the pitcher. The dampening member includes an annular member having an inner peripheral edge and an outer peripheral edge. The outer peripheral edge has a diameter generally equal to a diameter of the peripheral wall such that the outer peripheral edge may frictionally engage the inner surface of the peripheral wall. A wall is attached to the outer peripheral edge and extends downwardly from the annular member. The wall has a plurality of apertures extending therethrough.

Still yet another object of the present invention is to provide a new spill reducing device for a pitcher that prevents ice or other articles in a liquid from spilling outward of a pitcher.

Even still another object of the present invention is to provide a new spill reducing device for a pitcher that provides a medium for the placemen of advertising indicia.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a schematic perspective view of a second embodiment of the present invention.

FIG. 7 is a schematic perspective view of the dampening member of the second embodiment of the present invention.

FIG. 8 is a schematic perspective view of a third dampening member of the present invention.

DESCRIPTION OF THE PREFERRED EMBODIMENT

Figure 1:
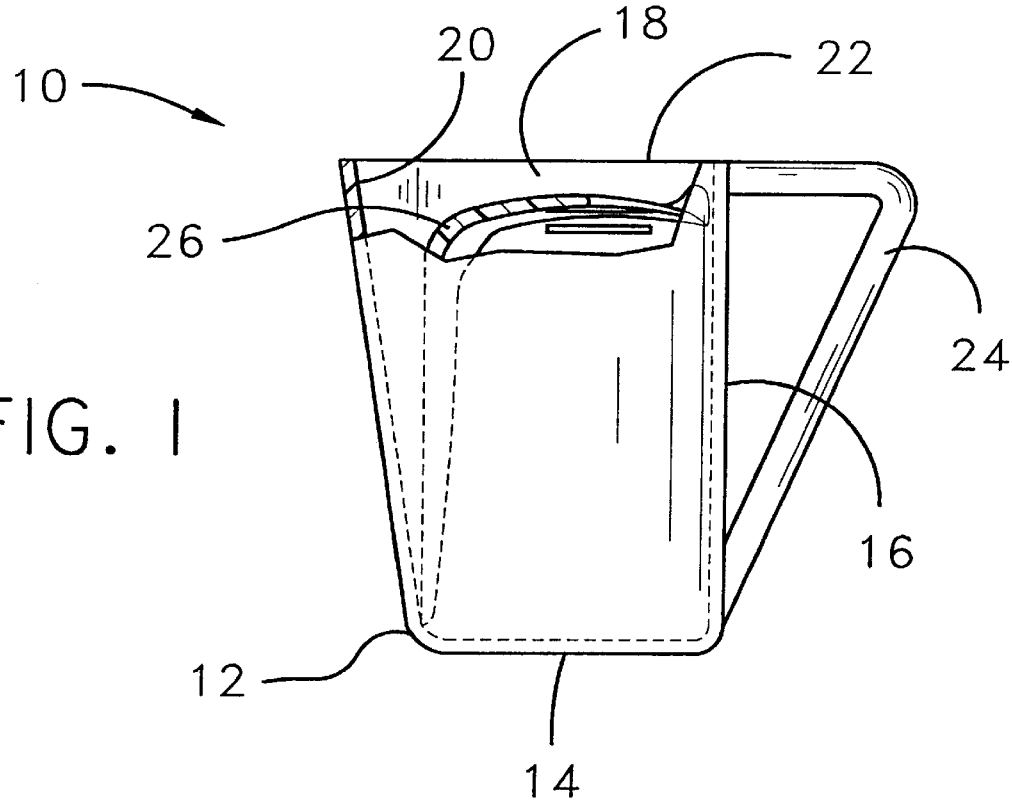
FIG. 1 is a schematic side view of a new spill reducing device for a pitcher according to the present invention.
Figure 2:
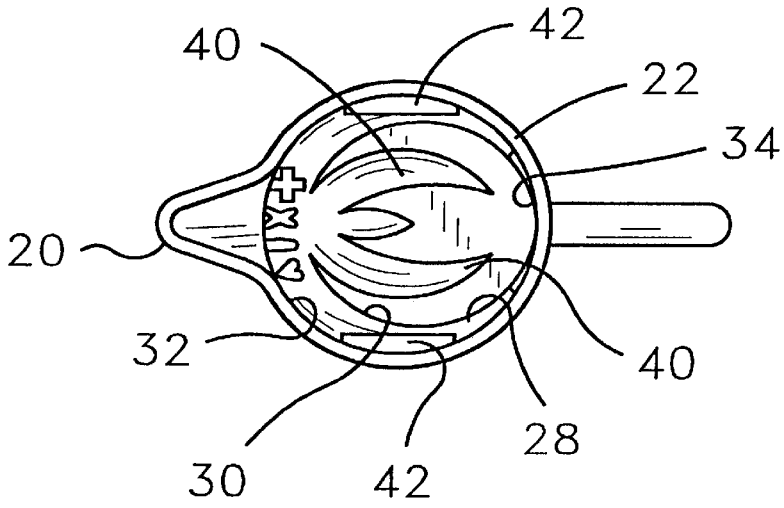
FIG. 2 is a schematic top view of the present invention.

With reference now to the drawings, and in particular to FIGS. 1 through 8 thereof, a new spill reducing device for a pitcher embodying the principles and concepts of the present invention and generally designated by the reference numeral 10 will be described.

As best illustrated in FIGS. 1 through 5, the spill reducing device 10 generally comprises a pitcher 12 having a bottom wall 14 and a peripheral wall 16 which is attached to and extends upwardly from the bottom wall 14. The peripheral wall 16 includes an inner surface 18 having an indentation 20 therein extending from the bottom wall 14 to an upper edge 22 of the peripheral wall 16. The indentation 20 defines a pour spout. A handle 24 is attached to an outer surface of the peripheral wall 16 and is located generally opposite of the pour spout 20.

A dampening member 26 slows outward flow of liquid from the pitcher 12. The dampening member 26 is removably positionable in the pitcher 26 between the pour spout 22 and a remaining inner portion of the pitcher 12. The dampening member 26 includes an annular member 28 and a wall 50.

The annular member 28 has an inner peripheral edge 30 and an outer peripheral edge 32. The annular member 28 has a break 34 therein such that a pair of free ends 36 are defined. The annular member 28 has a pair of bends 38 therein each positioned generally adjacent to one of the free ends 36 such that each of the free ends 36 extends upwardly and defines a tab. A plurality of fingers 40 is attached to the inner peripheral edge 30 of the annular member 28 and is positioned such that the fingers 40 generally extend toward the break 34. The outer peripheral edge 32 has a diameter generally equal to a diameter of the peripheral wall 16 such that the outer peripheral edge 32 may frictionally engage the inner surface 18 of the peripheral wall 16. The peripheral wall 16 may have a plurality of raised members 42 for engaging the annular member 28.

Figure 3:
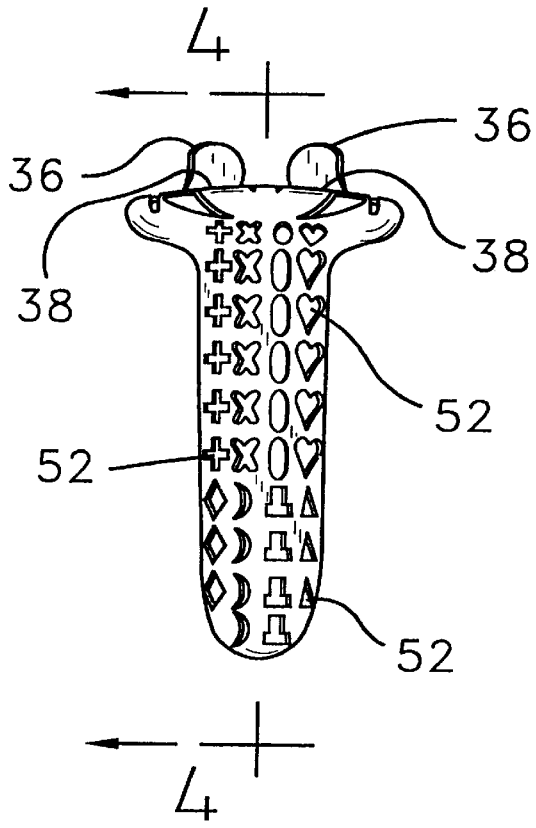
FIG. 3 is a schematic front view of the present invention.
Figure 4:
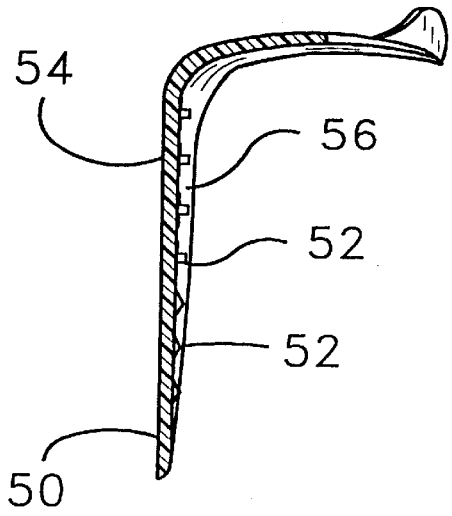
FIG. 4 is a schematic cross-sectional view taken along line 4—4 of FIG. 3 of the present invention.
Figure 5:
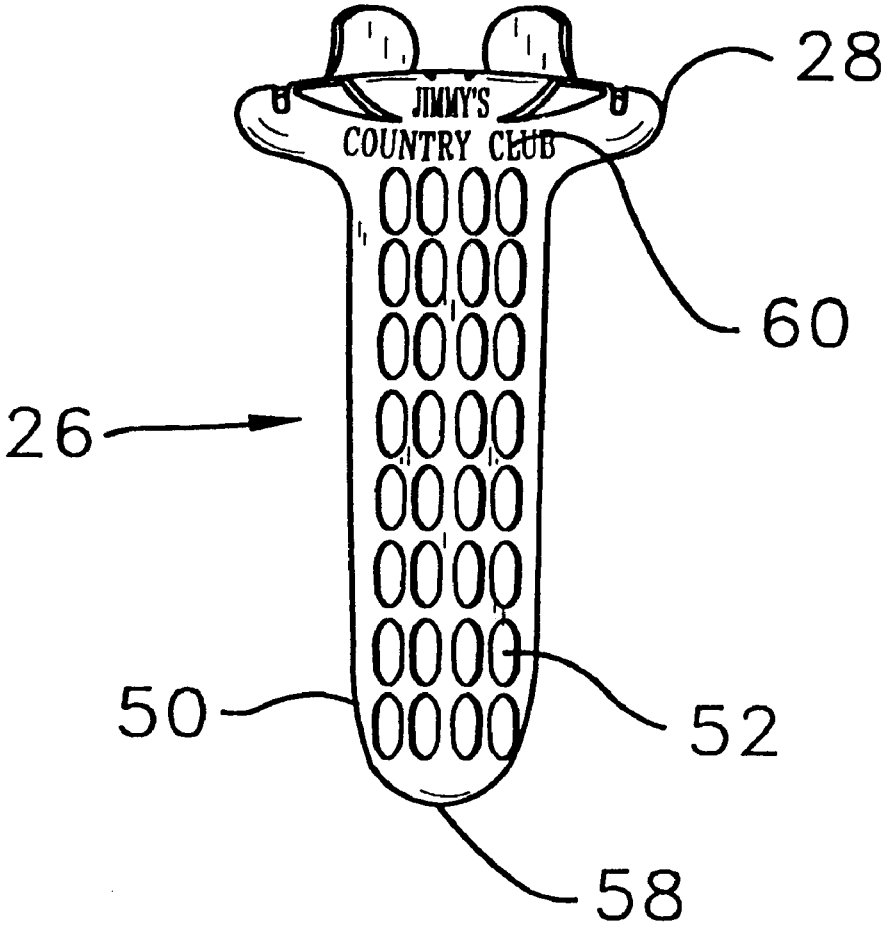
FIG. 5 is a schematic front view of the present invention.

The wall 50 is attached to the outer peripheral edge 32 and extends downwardly from the annular member 28. The wall 50 has a plurality of apertures 52 extending therethrough. The apertures 52 are spaced along the length of the wall 50. The wall 50 is located generally opposite of the break 34. The wall 50 has an arcuate outer surface 54 and inner surface 56 generally following the contour of the annular member 28. The wall 50 has an arcuate bottom edge 58. As shown in FIGS. 3 and 5, the apertures 52 may have different designs and advertisement indicia 60 may be positioned on the dampening member 26.

A second embodiment 70 of the damping member is shown in FIG. 6 and utilizes a damping member with a different configuration of fingers 40. FIG. 8, a third embodiment 71, uses no fingers but instead a domed panel. FIG. 6 also shows catches 72 attached to the inner surface 18 of the pitcher 12 and positioned on opposite sides of the spout 20. Apertures 73 extend through the annular member and each is positioned generally adjacent to one of the tabs 36. The catches 72 may be positioned in the apertures 73 for securely holding the damping member in the pitcher 26.

In use, liquid is positioned in the pitcher 12 along with solid material such as ice cubes or fruit. The dampening member 26 is then positioned in the pitcher 12 with the wall 50 adjacent to the pour spout 20. The apertures 52 and the fingers 40 allow liquid to pass through the dampening member 26 while preventing the solid material from leaving the pitcher 12 and causing the liquid to spill as it is being poured from the pitcher 12. The apertures 52 are positioned in the wall 50 such that any floating material does not interfere with the passage of the liquid to the pour spout 20. When finished, the tabs 36 may be pushed together to release the dampening member 26 from its frictional engagement with the pitcher 12. The annular member 28 may also be positioned between the raised members 42 and the bottom wall 14 for holding the dampening member 26 in position. The tabs 36 may then being used to move the annular member 28 past the raised members 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for preventing spilling of liquid, said device being positionable in a pitcher having a bottom wall, a peripheral wall extending upwardly from said bottom wall, and a pour spout being positioned in said peripheral wall, said device comprising:

a dampening member for slowing outward flow of liquid from said pitcher, said dampening member being removably positionable in said pitcher between said pour spout and a remaining inner portion of said pitcher, said dampening member including;

an annular member having an inner peripheral edge and an outer peripheral edge, said outer peripheral edge having a diameter generally equal to a diameter of the peripheral wall such that said outer peripheral edge may frictionally engage the inner surface of said peripheral wall; and a wall being attached to said outer peripheral edge and extending downwardly from said annular member, said wall having a plurality of apertures extending therethrough.

2. A device for preventing spilling of liquid, said device being positionable in a pitcher having a bottom wall, a peripheral wall extending upwardly from said bottom wall, and a pour spout being positioned in said peripheral wall, said device comprising:

a dampening member for slowing outward flow of liquid from said pitcher, said dampening member being removably positionable in said pitcher between said pour spout and a remaining inner portion of said pitcher, said dampening member including;

an annular member having an inner peripheral edge and an outer peripheral edge, said outer peripheral edge having a diameter generally equal to a diameter of the peripheral wall such that said outer peripheral edge may frictionally engage the inner surface of said peripheral wall;

a wall being attached to said outer peripheral edge and extending downwardly from said annular member, said wall having a plurality of apertures extending therethrough; and wherein said annular member has a break therein such that a pair of free ends are defined.

3. The device for preventing spilling of liquid as in claim 2, wherein said annular member has a pair of bends therein each positioned generally adjacent to one of said free ends such that each of said free ends extends upwardly and defines a tab.

4. The device for preventing spilling of liquid as in claim 2, wherein a plurality of fingers are attached to said inner peripheral edge of said annular member and being positioned such that said fingers generally extend toward said break.

5. The device for preventing spilling of liquid as in claim 2, wherein said wall is located generally opposite of said break.

6. The device for preventing spilling of liquid as in claim 5, wherein said wall h as an arcuate outer surface and inner surface generally following the contour of said annular member.

7. A device for preventing spilling of liquid, said device comprising:

a pitcher having a bottom wall and a peripheral wall being attached to and extending upwardly from said bottom wall, said peripheral wall having an inner surface having an indentation therein extending from said bottom wall to an upper edge of said peripheral wall, said indentation defining a pour spout, a handle being attached to an outer surface of said peripheral wall and being located generally opposite of said pour spout;

a dampening member for slowing outward flow of liquid from said pitcher, said dampening member being removably positionable in said pitcher between said pour spout and a remaining inner portion of said pitcher, said dampening member including;

an annular member having an inner peripheral edge and an outer peripheral edge, said outer peripheral edge having a diameter generally equal to a diameter of the peripheral wall such that said outer peripheral edge may frictionally engage the inner surface of said peripheral wall;

a wall being attached to said outer peripheral edge and extending downwardly from said annular member, said wall having a plurality of apertures extending therethrough; and wherein said annular member has a break therein such that a pair of free ends are defined.

8. The device for preventing spilling of liquid as in claim 7, wherein said annular member has a pair of bends therein each positioned generally adjacent to one of said free ends such that each of said free ends extends upwardly and defines a tab.

9. The device for preventing spilling of liquid as in claim 10, wherein a plurality of fingers are attached to said inner peripheral edge of said annular member and being positioned such that said fingers generally extend toward said break.

10. The device for preventing spilling of liquid as in claim 7, wherein said wall is located generally opposite of said break.

11. The device for preventing spilling of liquid as in claim 10, wherein said wall has an arcuate outer surface and inner surface generally following the contour of said annular member.

12. A device for preventing spilling of liquid, said device comprising:

a pitcher having a bottom wall and a peripheral wall being attached to and extending upwardly from said bottom wall, said peripheral wall having an inner surface having an indentation therein extending from said bottom wall to an upper edge of said peripheral wall, said indentation defining a pour spout, a handle being attached to an outer surface of said peripheral wall and being located generally opposite of said pour spout, a pair of catches being attached to said inner surface and being positioned generally opposite of each other, said catches being located on opposite sides of said spout;

a dampening member for slowing outward flow of liquid from said pitcher, said dampening member being removably positionable in said pitcher between said pour spout and a remaining inner portion of said pitcher, said dampening member including;

an annular member having an inner peripheral edge and an outer peripheral edge, said annular member having a break therein such that a pair of free ends are defined, said annular member having a pair of bends therein each positioned generally adjacent to one of said free ends such that each of said free ends extends upwardly and defines a tab, said annular member having a pair of apertures extending therethrough, each of said apertures being positioned generally adjacent to one of said tabs and being positioned for receiving one of said catches, a plurality of fingers being attached to said inner peripheral edge of said annular member and being positioned such that said fingers generally extend toward said break, said outer peripheral edge having a diameter generally equal to a diameter of said peripheral wall such that said outer peripheral edge may frictionally engage the inner surface of said peripheral wall; and a wall being attached to said outer peripheral edge and extending downwardly from said annular member, said wall having a plurality of apertures extending therethrough, said wall being located generally opposite of said break, said wall having an arcuate outer surface and inner surface generally following the contour of said annular member, said wall having an arcuate bottom edge;

wherein said annular member may be positioned in said pitcher such that said wall is facing said spout and each of said catches are positioned in one of said apertures.

* * * * *